US008844705B2

(12) United States Patent
Braukmann et al.

(10) Patent No.: US 8,844,705 B2
(45) Date of Patent: Sep. 30, 2014

(54) CASH BOX SYSTEM FOR A VENDING MACHINE

(75) Inventors: Èrwin Braukmann, Wolfratshausen (DE); Sime Jovic, München (DE)

(73) Assignee: RTB GmbH & Co. KG, Bad Lippspringe (DE)

( * ) Notice: Subject to any disclaimer, the term of this patent is extended or adjusted under 35 U.S.C. 154(b) by 209 days.

(21) Appl. No.: 12/515,346

(22) PCT Filed: Aug. 22, 2007

(86) PCT No.: PCT/EP2007/058709
§ 371 (c)(1), (2), (4) Date: May 18, 2009

(87) PCT Pub. No.: WO2008/061818
PCT Pub. Date: May 29, 2008

(65) Prior Publication Data

US 2009/0272621 A1 Nov. 5, 2009

(30) Foreign Application Priority Data

Nov. 21, 2006 (DE) ..... 10 2006 055 085

(51) Int. Cl.
*G07F 9/10* (2006.01)
*G07F 9/06* (2006.01)
*G07D 9/00* (2006.01)

(52) U.S. Cl.
CPC .. *G07F 9/06* (2013.01); *G07D 9/00* (2013.01); *Y10S 902/09* (2013.01); *Y10S 902/13* (2013.01)
USPC ..... 194/350; 194/351; 232/15; 206/0.815; 206/0.82; 414/332; 414/407; 414/414; 902/9; 902/13

(58) Field of Classification Search
USPC ..... 206/0.8, 0.81, 0.815, 0.82, 0.84; 414/404, 407, 414, 332, 411; 194/350; 232/15, 16, 1 D, 43.1, 44
See application file for complete search history.

(56) References Cited

U.S. PATENT DOCUMENTS

| | | | | |
|---|---|---|---|---|
| 3,926,366 | A | 12/1975 | Sciortino | |
| 4,177,920 | A * | 12/1979 | Sciortino | 232/16 |
| 4,648,327 | A | 3/1987 | Hempfling et al. | |
| 5,209,395 | A | 5/1993 | Clauser et al. | |
| 6,059,090 | A * | 5/2000 | Davis et al. | 194/350 |
| 6,827,235 | B2 * | 12/2004 | Androsyuk et al. | 221/197 |

FOREIGN PATENT DOCUMENTS

| | | |
|---|---|---|
| EP | 0201427 A | 12/1986 |
| EP | 0269731 A | 6/1988 |
| EP | 0561579 A2 | 9/1993 |

(Continued)

OTHER PUBLICATIONS

Siemens AG; Bedienerhandbuch SITRAFFIC SITY 5/ PRISMA, Parkscheinautomat; Mar. 15, 2001; pp. 1-4 and 4-1 thru 4-12.

*Primary Examiner* — Jeffrey Shapiro
(74) *Attorney, Agent, or Firm* — Laurence A. Greenberg; Werner H. Stemer; Ralph E. Locher

(57) ABSTRACT

A cash box system with a cash container for receiving cash is described. The cash container has an inlet opening which can be closed by a cover and a locking mechanism having a locked state in which the cover is locked in a position closing the inlet opening, and a release state in which the cover is unlocked and can be brought in a position to release the inlet opening. The locking mechanism is configured such that it is forcibly transferred from the locked state to the release state when the cash container is emptied. The cash box system is preferably for a vending machine in which the cash container is inserted.

10 Claims, 7 Drawing Sheets

(56) References Cited

FOREIGN PATENT DOCUMENTS

| | | | |
|---|---|---|---|
| EP | 0571188 | A | 11/1993 |
| EP | 0807598 | A1 | 11/1997 |
| EP | 1383091 | A1 | 1/2004 |
| EP | 1655701 | A1 | 5/2006 |
| EP | 1703475 | A1 | 9/2006 |
| JP | S54108698 | A | 8/1979 |
| WO | WO 9919847 | A1 | 4/1999 |

* cited by examiner

CASH BOX SYSTEM FOR A VENDING MACHINE

CROSS REFERENCE TO RELATED APPLICATIONS

This application is the US National Stage of International Application No. PCT/EP2007/058709 filed Aug. 22, 2007 and claims the benefit thereof. The International Application claims the benefits of German Patent Application No. 10 2006 055 085.4 DE filed Nov. 21, 2006, both of the applications are incorporated by reference herein in their entirety.

FIELD OF INVENTION

The invention relates overall to a cash box system having a cash container for receiving cash, having a vending machine, in particular a parking ticket vending machine, in which the cash container can be inserted, having a collecting box for emptying the cash container and having a service vehicle, in which the collecting box is arranged.

BACKGROUND OF INVENTION

Vending machines having cash containers for receiving cash are used in a wide range of variants. A user can acquire a large number of goods and/or services from such vending machines against payment of cash. The vending machine receives the money, in particular coins, checks its value and validity and supplies cash that is deemed to be valid to the cash container. Vending machines of this kind are also known for example for the sale of travel tickets for public means of passenger transport or for parking tickets for car parks or public parking spaces.

Parking ticket vending machines are known from the user manual SITRAFFIC SITY 5/Prisma, edition A004/2001-03-15, published by Siemens AG, which comprises a columnar vending machine housing with a rectangular or triangular cross-section. Arranged in the upper part of the vending machine housing are an engineering box with control unit, coin-acceptor unit, printer, battery, optional GSM modem with antenna or radio clock, and a user interface with coin insertion slot, display, card reader, tariff information and a collection tray for parking tickets and change. In the lower part of the vending machine housing there is accommodated a cash box compartment with a separate locking system in which a cash box for receiving cash is inserted, the cash box comprising an inlet opening at its upper side which can be closed by a cover. Cash inserted into the parking ticket vending machine, whose validity has been established by the coin-acceptor unit, drops through a coin chute and the inlet opening into the cash box.

The known cash box comprises a locking mechanism which automatically locks the cash box as soon as it is removed from the parking ticket vending machine. For this purpose the locking mechanism must be activated by manual actuation of a tension lever arranged inside the cash box, however, before the cash box is inserted in the parking ticket vending machine. To empty the cashbox it must firstly be unlocked from the cash box compartment with a first cash box key in order to then be able to be removed with the aid of a pivotal handle at the front of the cash box. The cash box is then transported to a central emptying location, for instance a bank, where authorized emptying personnel open the front of the cash box with the aid of a second cash box key in order to empty the contents of the cash box. Said tension lever is then pulled forwards in order to tension the cash box locking mechanism again. Once the front door has been locked again using the second cash box key the cash box can be transported back to the parking ticket vending machine in order to be inserted into the cash box compartment again and be locked using the first cash box key.

The known locking mechanism prevents insertion of an emptied cash box in the cash box compartment however, if the tension lever has not been pulled forwards, i.e. the locking mechanism has not been activated. In this case the emptied box has to be brought back to the bank where the cash box has to be opened with the aid of the second cash box key in order to tension or activate the locking mechanism.

SUMMARY OF INVENTION

An object of the invention is to provide a cash box emptying system having a cash box for vending machines in which the changing of the cash box is less susceptible to mistakes made by service personnel and yet remains safe from unauthorized access to the cash by service personnel.

The object is achieved according to the invention by a cash box of the type mentioned in the introduction in which the locking mechanism is configured in such a manner that it is forcibly transferred from the locked state to the release state when the cash container is emptied. As the locking mechanism automatically transfers from its locked state into the release state when the cash box is emptied—i.e. not as a result of separate manual handling—the situation where activation of the locking mechanism in the emptying location is forgotten cannot occur. This avoids the return transport to the emptying station that is sometimes required in the case of the emptied but accidentally not activated cash box according to the prior art. The cash box is forcibly brought into the release state of the locking mechanism when emptied, so the cash box may be inserted in the vending machine. The cover is therefore forcibly unlocked in the process and can be brought into its position uncovering the inlet opening when the cash box is inserted in the vending machine.

The cash container preferably comprises an emptying opening that can be closed by a door; the locking mechanism comprises a positioning element which is coupled to the door in such a manner that the locking mechanism is forcibly transferred from the locked state to the release state when the door is opened. The door that is specially provided for emptying the cash box can be constructed as a removable door, as an articulated swing door or as a sliding door. A coupling between this door and the locking mechanism via a positioning element means that when the cash box is emptied—for which purpose the door of the emptying opening has to be forcibly opened—the locking mechanism is automatically switched from its locked state into the release state.

In an advantageous embodiment of the cash container the door forcibly actuates the positioning element only as it approaches it open end position. To automatically re-position the locking mechanism it is therefore necessary in this embodiment to open the door at least almost completely, whereby the cash in the cash container is completely emptied out and cash does not remain in the container as a result of a door that is only partially open.

In a preferred embodiment of the cash container the locking mechanism comprises a stop element which can be moved between a locked position blocking the closed cover against opening, and a release position allowing the cover to open, and a deflecting element coupled to the stop element, by means of which the stop element can be moved against a restoring spring force from the blocked position into the release position. This embodiment can be constructed as a purely mechanical solution, i.e. independently of an electrical supply, and in a constructively simple manner implements the functions of the locking mechanism. The stop element, which optionally blocks or unblocks the opening path of the cover, is held in the locked position by a spring or forced in the direction thereof. The release position of the stop element corresponds to the release state of the locking mechanism in which the deflecting element coupled to the stop element prevents the stop element from falling back into its locked position.

In an advantageous embodiment of the cash container the locking mechanism comprises holding means which fix the deflecting element if the stop element has assumed the release position. This can fix the release state of the locking mechanism, which is adjusted by emptying the cash container, until the cash container has been transported from an emptying station back to the vending machine and has been inserted therein.

In a preferred embodiment of the cash container it is constructed so as to be box-shaped, having a top wall on which the inlet opening with cover is arranged, and having a bottom wall on which the emptying opening with door is arranged, wherein the positioning element is constructed as a double lever, of which the first lever arm is coupled to the door and with its second lever arm can position the deflecting element. The opposing arrangement of inlet opening and emptying opening on the box-shaped cash container advantageously makes use of the effect of gravity on the one hand during the feeding movement of cash to the cash container as well as during removal via the emptying opening. Bridging of the physical distance between the action site "opening of the door" and reaction site "positioning of the deflecting element" is again achieved purely mechanically by a lever-like positioning element, of which the first lever arm extends to the bottom wall and of which the second lever arm extends to the top wall.

In the cash container the cover is preferably displaceably arranged in such a way that when it is opened it releases the deflecting element from the holding means but prevents the stop element from springing back into the locked position until the cover is closed again. This means that when the cash container is inserted in the vending machine, the deflecting element can be released from the holding means in that the cover, which forcibly opens when the cash container is inserted, presses the deflecting element from the holding means but simultaneously prevents the stop element from springing back into its locked position. The stop element only springs back into the locked position if the cover is closed again. The stop element does not engage with the holding means during this springing-back, however, so the cover is locked in its position closing the inlet opening.

So said operation proceeds automatically when the cash container is removed from the vending machine, in a further advantageous embodiment of the cash container the displaceably mounted cover is coupled to a spring element, against whose spring force the cover can be brought from a position closing the inlet opening into a position that uncovers it. The cover can be constructed as a slide with guided movement in this connection, on which an opening force is placed when the cash container is inserted in the vending machine, and this is cancelled when the cash container is removed.

In a further preferred embodiment of the cash container it has a front wall and a C-shaped handle immovably secured thereto. As the handle is immovably secured to the cash container, it can be safely carried on removal or insertion of the cash container from/in the vending machine as well as during transportation and emptying as the service personnel do not have to balance out any movements of the cash container which would occur as a result of a, for instance, rotatably articulated handle.

In a further advantageous embodiment of the cash container the handle is advantageously vertically oriented. Swinging of the cash container at the side of the body of the service employee, who is transporting the cash container, is therefore possible without additional rotation of the wrist, and this tallies with a more ergonomically natural posture.

In a further preferred embodiment of the cash container the front wall comprises an indentation at least in the region of the handle. This indentation means that the handle is located closer to the cash container's center of gravity than without an indentation. This measure also improves ergonomics as the torque acting via the cash container on the service employee's hand attached to the handle is lower.

In a likewise advantageous embodiment of the cash container the handle is constructed as a plastics material part with a cross-section that is rectangular at least in certain sections. With an appropriate cross-sectional size and handle length this embodiment again improves ergonomics as the handle can be held more securely by a hand that encompasses it and the feel is more pleasant than with metal handles.

According to the invention the object mentioned in the introduction is also achieved by a vending machine, in particular parking ticket vending machine, having a machine housing which comprises a user interface for receiving cash and in which a receptacle for insertion of a cash container is arranged. Vending machines of this kind are a particularly advantageous application for cash containers.

In an advantageous embodiment of the vending machine the receptacle comprises sliding means that cooperate with the cover of the cash container and which forcibly displace the cover into its position uncovering the inlet opening when the cash container is inserted. By way of example the sliding means can be constructed as a mandrel arranged on the receptacle, against which mandrel the cover of the cash container is pressed when it is inserted in the vending machine.

In a particular embodiment of the vending machine the receptacle comprises guides for insertion and removal of the cash container into or from the receptacle. The guides facilitate introduction of the cash container into the vending machine in a defined operating position for the service personnel, in which position the cash removed from the vending machine also passes reliably through the inlet opening and into the cash container. The guides also ensure that the sliding means are placed in the correct position on the cash container cover when the container is inserted in the vending machine.

In an advantageous embodiment of the vending machine the receptacle is arranged in a safe, having a closable safe door, disposed in the vending machine housing, the safe comprising a chute opening. In an advantageous manner the inside of the safe can serve as a receptacle, sliding means and guides being arranged on the inner walls of the safe. Anti-theft protection is increased by incorporating the cash container in a closable safe. Only service personnel have the appropriate keys for the door in the vending machine housing and the safe door.

According to the invention the cash box system is supplemented by a collecting box for emptying a cash container and comprises a filling opening, which can be closed by a cover, for cash, and comprising a connecting mechanism for connecting a cash container that is to be emptied, wherein the emptying opening of a connected cash container is positioned above the filling opening and wherein the door is engaged with the cover in such a manner that door and cover can only be displaced together. Without a connected cash container the filling opening of the collecting box is closed by a cover, so there is no access to the cash located in the collecting box. It is only possible to open the cover when the cash container is connected and, more precisely, together with the door for the emptying opening in the cash container. The connecting mechanism ensures that the cash container is placed on the collecting box in a defined emptying position.

In an advantageous embodiment of the collecting box the cash container comprises a door lock for the door and a cover key for the cover and the connecting mechanism comprises a cover lock for the cover and a door key for the door, which are arranged in such a way that the keys are guided into the associated locks when the cash container is connected. The collecting box and cash container thus each provide the key for the lock of the respective other container, so neither of the two containers can be opened without the other. It is therefore only possible to open the two containers in the defined connecting position which should be assumed when the cash container is emptied. This solution also prevents keys from being lost or the wrong keys being provided.

In a preferred embodiment of the cash container the connecting mechanism comprises a locking element by means of which the keys can be actuated in the locks together. Opening and closing of the two locks by actuation of only a single locking element simplifies handling of the cash box system and reduces the duration of the emptying procedure.

In a preferred embodiment of the cash box it has an upper side on which the connecting mechanism is arranged at the edge. This arrangement at the edge facilitates connection of a filled cash container to the collecting box because holding up and positioning of a filled cash container by service personnel in a bent posture or with outstretched arms is avoided.

In an advantageous embodiment of the collecting box it comprises at least two connecting mechanisms. The provision of a plurality of connecting mechanisms means that a plurality of cash containers can advantageously be emptied simultaneously, and this allows emptying to take place in a shorter time.

Finally, a service vehicle for emptying a cash container inserted in a vending machine is proposed for the cash box system, in which a collecting box is arranged. The collecting box can be so heavy that it can only be removed from the cargo space of the service vehicle with the aid of a forklift truck. The service vehicle can then take a route on which vending machines or groups of vending machines with cash containers for emptying are located. At the end of the emptying route the service vehicle drives to a central bank in which the collecting box of the service vehicle is emptied. Only authorized bank personnel can open a closed collecting box emptying cover, so the service personnel does not have access to the collected cash at any time along the service route. Not only is it impossible for the service personnel to misappropriate cash as a result of the cash box system, conversely the cash box system provides no basis for such suspicions.

BRIEF DESCRIPTION OF THE DRAWINGS

An exemplary embodiment of the cash box system will be described in more detail hereinafter with reference to drawings, in which schematically illustrated.

DETAILED DESCRIPTION OF INVENTION

Figure 1:
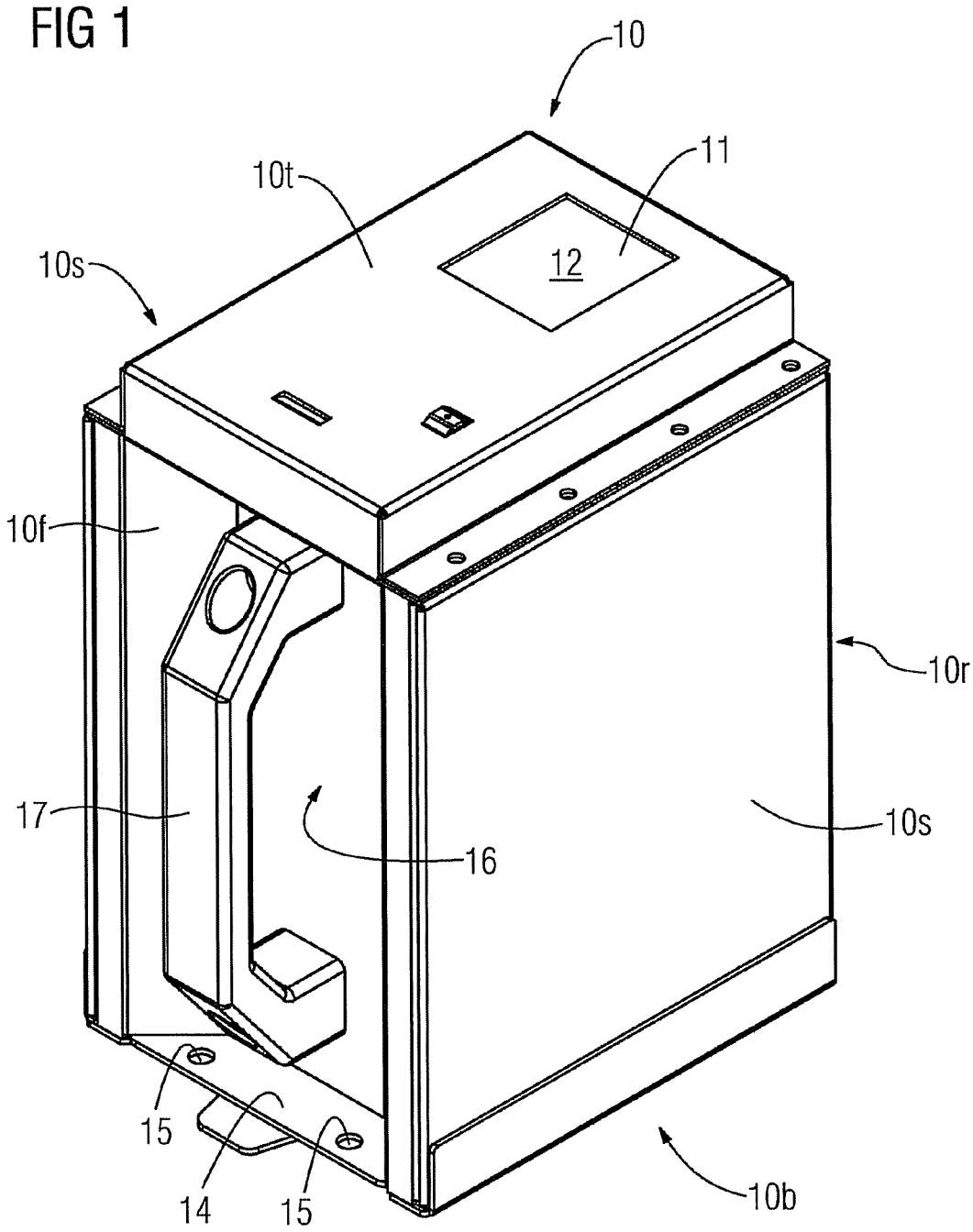
FIG. 1 shows a cash container in a perspective view.

According to FIG. 1 to FIG. 4 a cash container 10 is constructed so as to be box-shaped and comprises a top wall 10*t*, a front wall 10*f*, a back wall 10*r*, two side walls 10*s* and a bottom wall 10*b*. In the position inserted in a vending machine, for instance a parking ticket vending machine, the top wall 10*t* is located at the top and the bottom wall 10*b* at the bottom. The top wall 10*t* comprises an inlet opening 11 for cash, in particular in the form of coins, which can be closed by a cover 12 constructed as a displaceable slide. The bottom wall 10*b* includes an emptying opening 13 which can be closed by a displaceable door 14. To insert or remove the cash container 10 in or from a vending machine a c-shaped, vertically oriented handle 17 is immovably secured to the front wall 10*f* by means of two screws. The handle 17 is designed as a plastics material part with a rectangular cross-section at least in certain sections and is secured in a trapezoidal indentation 16 in the front wall 10*t* so the handle is arranged closer to the cash container's 10 center of gravity. The length of the handle extends almost over the entire height of the cash container 10, while the rectangular cross-section is constructed to be as large as possible so it can be securely held in the hand. This configuration of the handle 17 has significant ergonomic advantages in terms of the handling of the cash container 10. Thus the cash container can be removed from the vending machine and carried in largely natural postures. The cash container 10 comprises a locking mechanism with a locked state in which the cover 12 is locked in a position closing the inlet opening 11, and a release state in which the cover 12 is unlocked and can be brought into a position uncovering the inlet opening 11.

Figure 2:
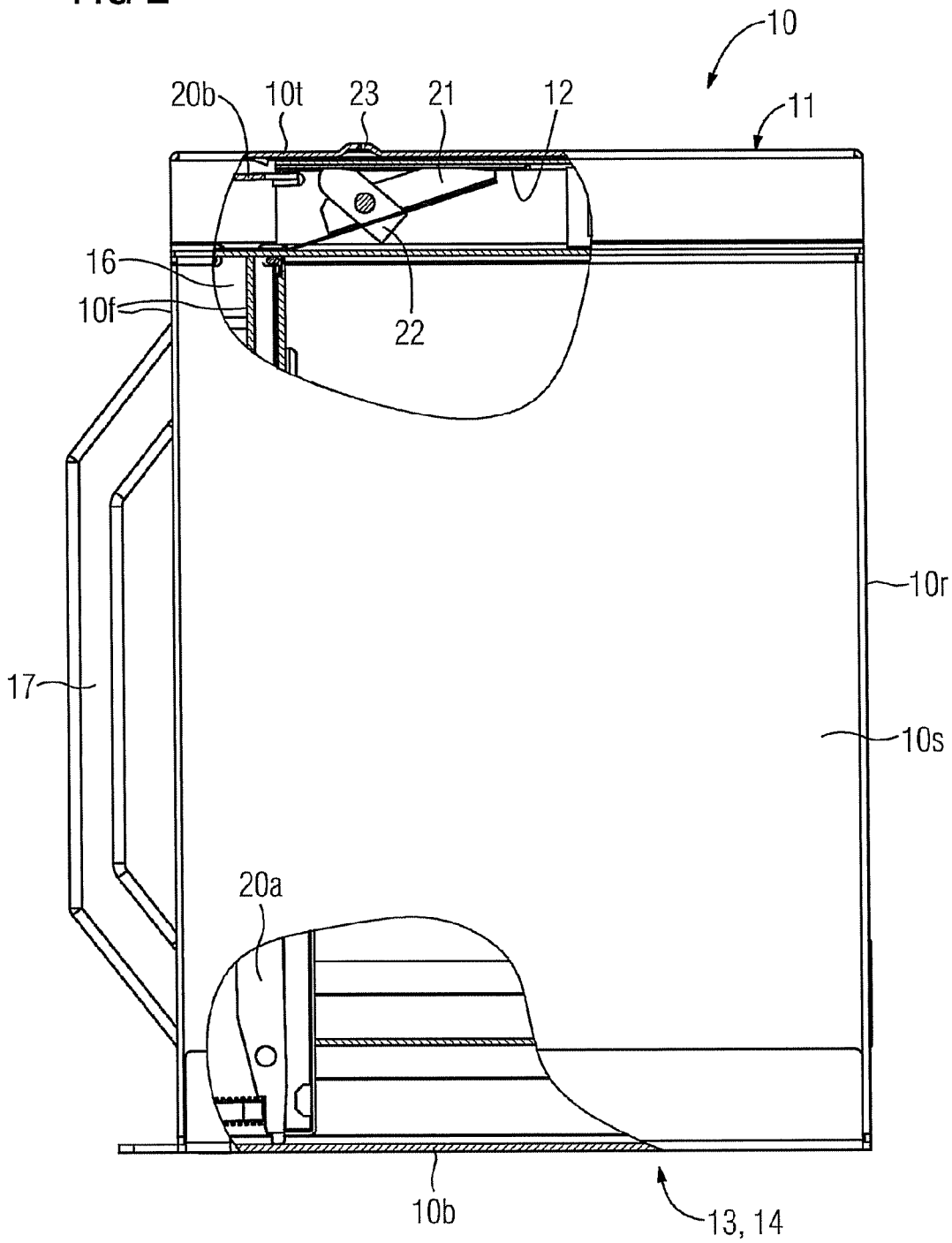
FIG. 2 shows a cash container in a partially cut side view with open cover.

If the cash container 10 is inserted in a vending machine then according to FIG. 2 the cover 12 constructed as a displaceable slide is displaced to the left and in the process assumes its position that uncovers the inlet opening 11. The emptying opening 13 in the bottom wall 10*b* on the other hand is closed by the door 14 that has been pushed shut. In this operating state cash, in particular coins, which has been deemed to be valid by a coin-acceptor unit, received by a vending machine can be let into the cash container 10 through a coin chute and be stored therein. For the vending machine to continue operating it must always be able to receive cash. For this purpose the cash container 10 should be replaced regularly with an empty cash container 10. To ensure that the service personnel entrusted with changing the containers cannot access the cash located in the cash container 10 the cover 12 automatically closes the inlet opening 11 by way of measures described below when the cash container 10 is removed from the vending machine.

Figure 3:
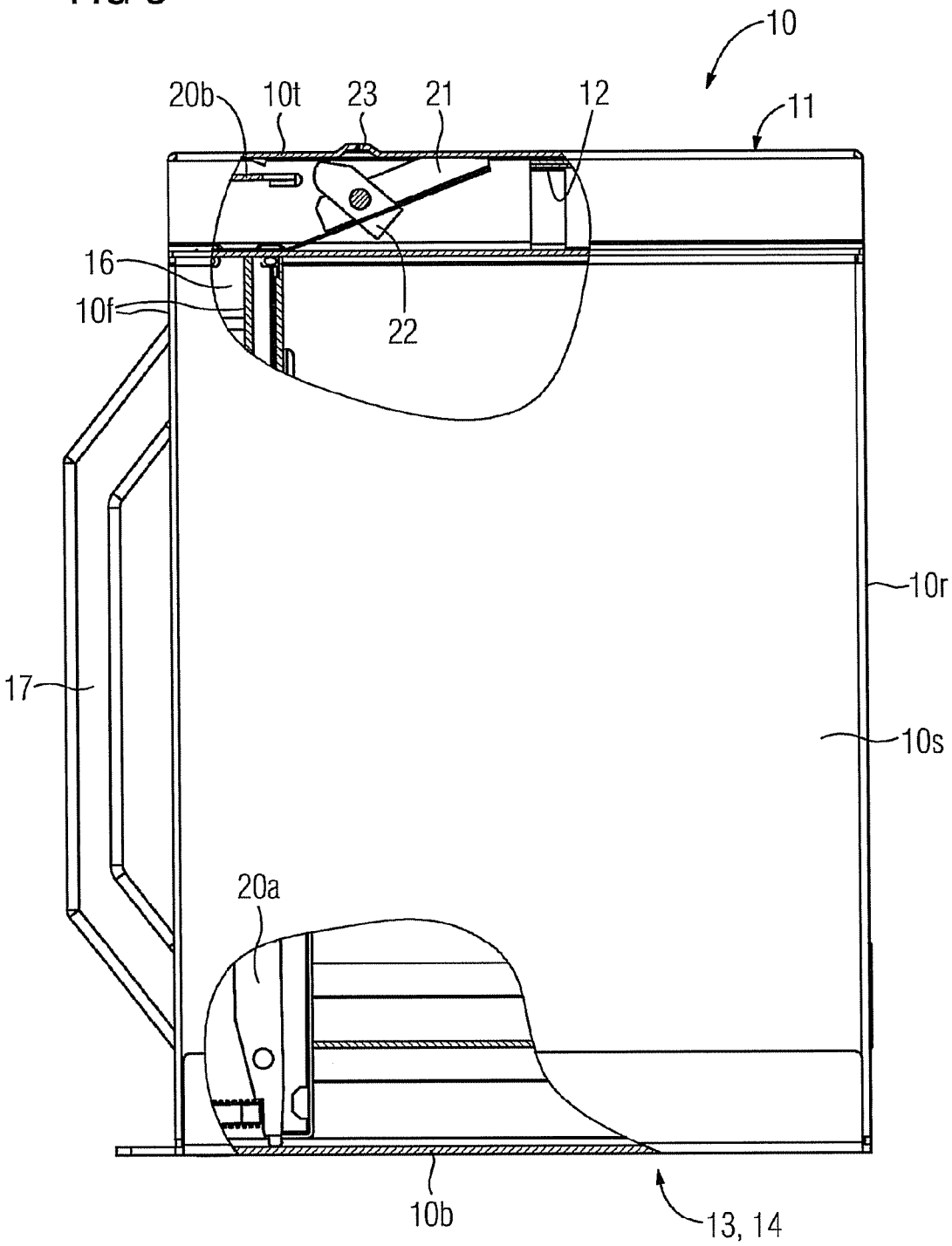
FIG. 3 shows a cash container in a partially cut side view with closed, locked cover.
Figure 4:
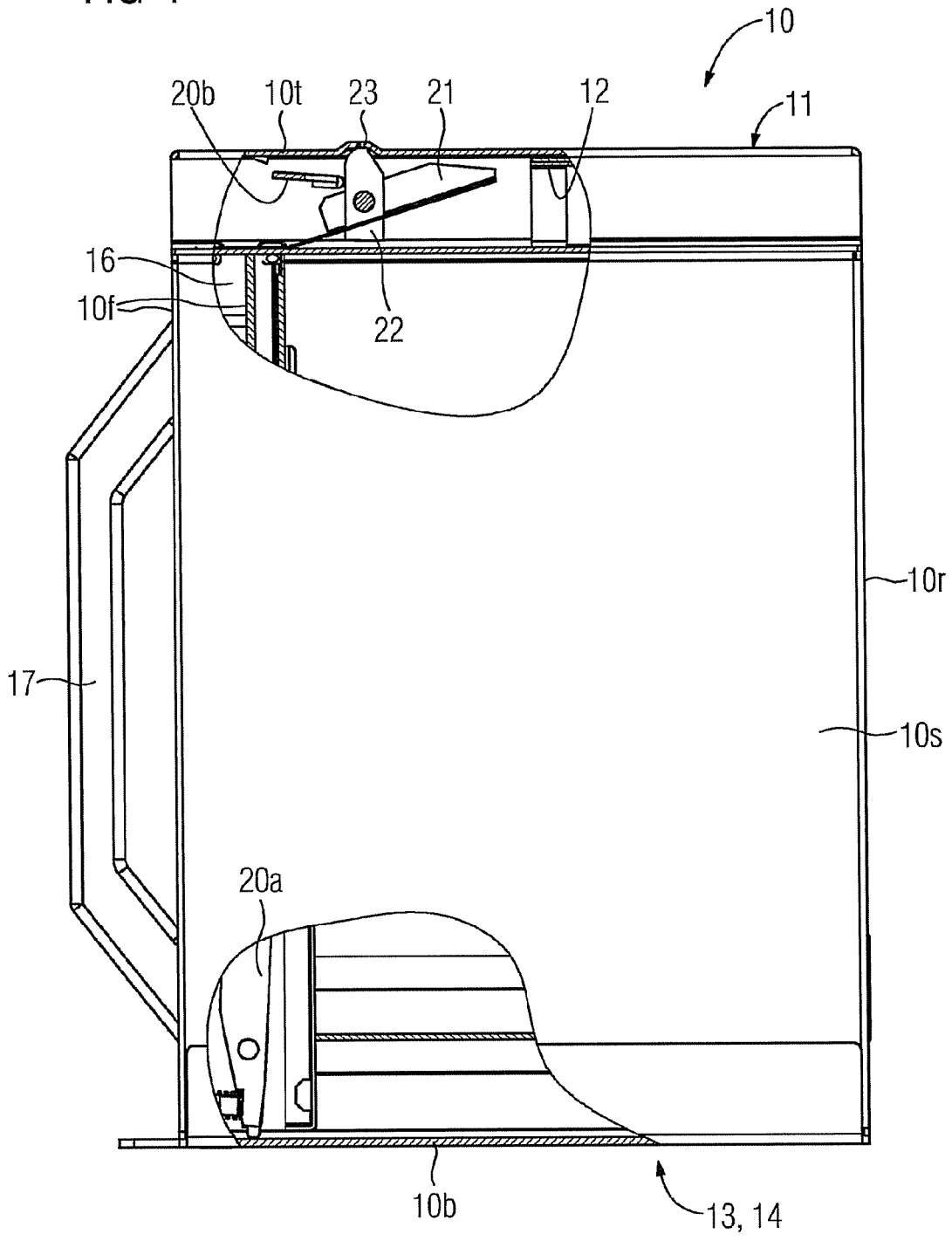
FIG. 4 shows a cash container in a partially cut side view with closed, unlocked cover.

According to FIG. 3 the cover 12 configured as a slide is in the process pushed into its right-hand end position and the locking mechanism transferred from its release state into the locked state. The locking mechanism comprises a stop element 21 for this purpose, which is resiliently articulated to the cash container 10 and is forced upwards in the direction of the top wall 10*t* by the spring force. As long as the cover 12 is open the stop element 21 rests on a side face of the cover 12, so it may be freely displaced according to FIG. 2 until the cover 12 is brought into its position closing the inlet opening 11. The stop element 21 then rests on the inner side of the top wall 10*t* and blocks opening of the cover 12.

According to the invention the locking mechanism is forcibly transferred from its locked state back into its release state when the cash container 10 is emptied. For this purpose the locking mechanism comprises a positioning element 20 constructed as a double lever, of which the first lever arm 20*a* is coupled to the door 14 and with its second lever arm 20*b* can adjust the stop element 21 via a deflecting element 22. The lever-like positioning element 20 is rotatably mounted about a shaft arranged at approximately half the height of the cash container 10 and is actuated as follows: the door 14 constructed as a sliding element has a recess into which the end of the first lever arm 20*a* projects. The recess in the door 14 is produced by a cutout whose length is dimensioned such that when the door 14 is slid open the first lever arm 20*a* is only carried along by the end of the recess if the door 14 has approximately reached its position releasing the emptying opening 13. When completely open the door 14, against a spring force, carries along the first lever arm 20*a* for a certain distance to the left according to FIG. 4. This causes the second lever arm 20*b* to be moved to the right for a distance corresponding to the length of the lever arms according to FIG. 4. A deflecting element 22 rotatably coupled to the stop element 21 is displaced in the process such that according to FIG. 4 the stop element 21 is moved into its release position allowing the cover 12 to open. This release position is fixed in that the deflecting element 22 is forced by the second lever arm 20*b* into the holding means 23, which are constructed as an indentation formed in the top wall 10*t*.

If after emptying of the cash container 10 the door 14 is pushed back again, the spring on the first lever arm 20*a* presses the positioning element 20 back into its normal position—as shown in FIG. 2 and FIG. 3—the stop element 21 remaining in its release position owing to the deflecting element 22 fixed in the holding means 23. Therefore, by opening the door 14 the locking mechanism has forcibly been transferred from its locked state into the release state. The emptied cash container 10 can now be inserted in a vending machine again as the opening movement of the cover 12 is no longer blocked by the stop element 21.

Figure 5:
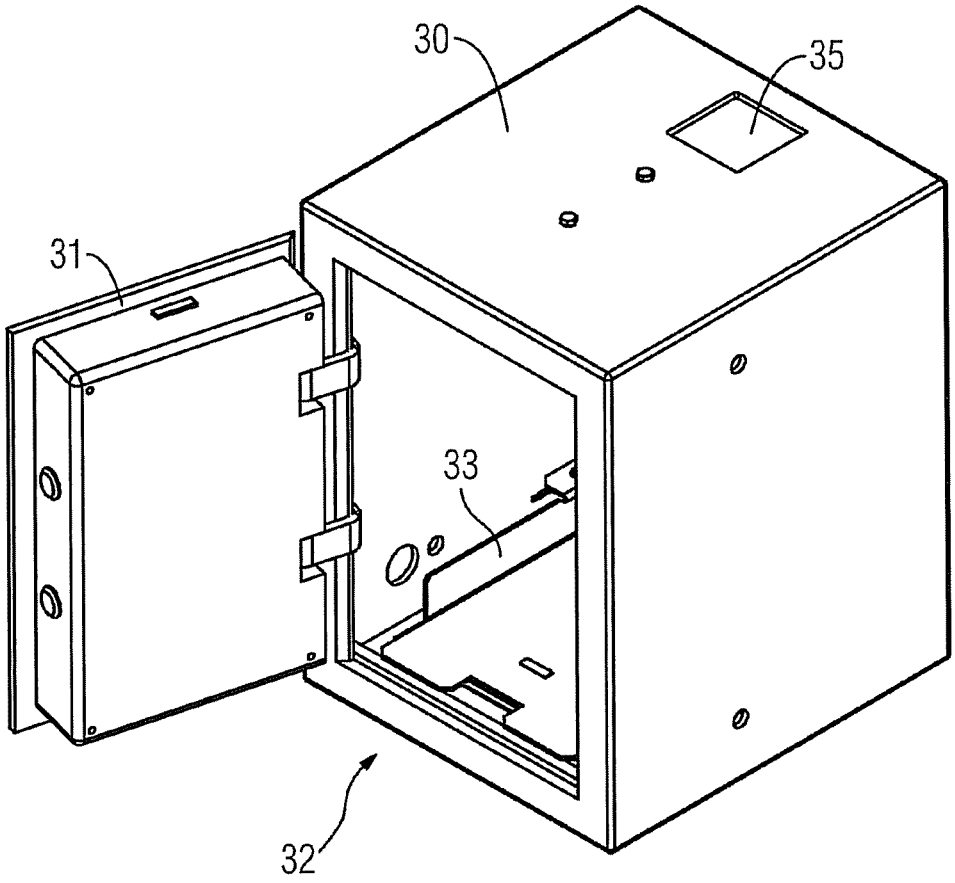
FIG. 5 shows a receptacle, formed by a safe, for a cash container of a vending machine in a three-dimensional view.
Figure 6:
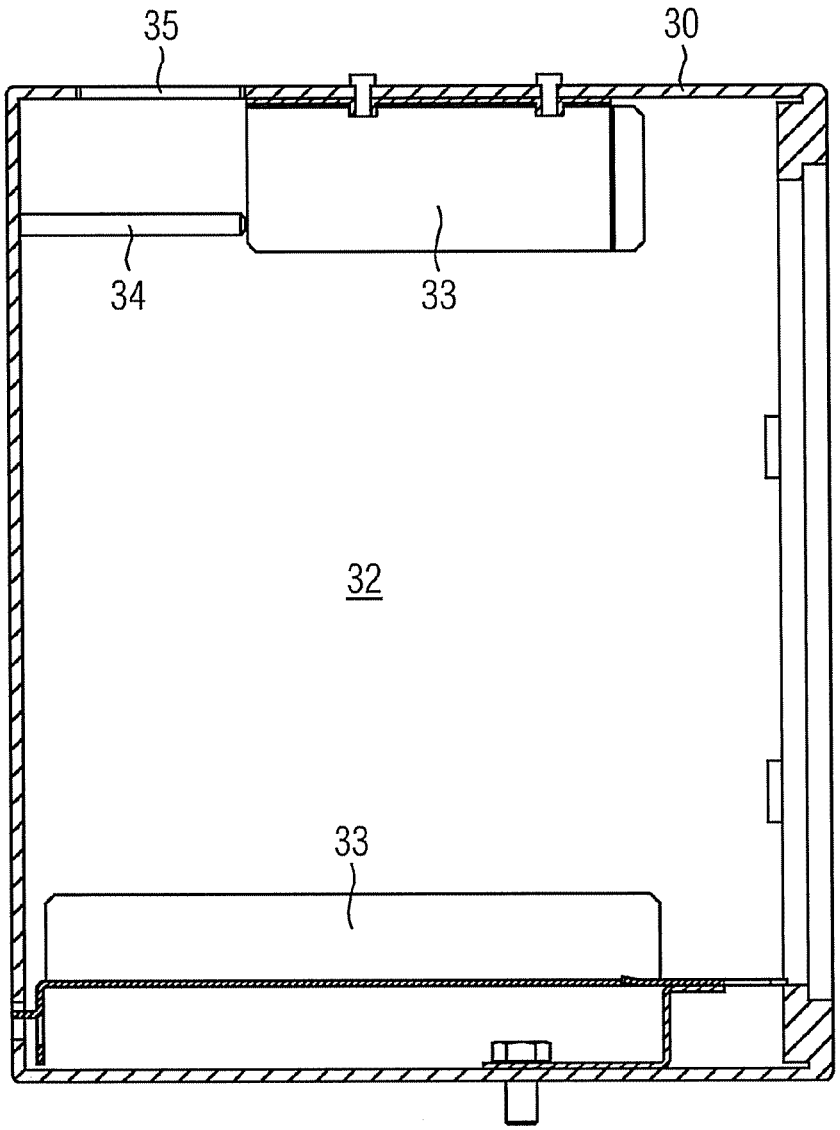
FIG. 6 shows the safe from FIG. 5 in a cut side view.

To protect against theft the cash container 10 is placed according to FIG. 5 and FIG. 6 in a safe 30, arranged in the vending machine, having a lockable safe door 31. The interior of the safe 30 serves as a receptacle 32 for the cash container 10 and is equipped with lateral guides 33 to facilitate introduction of the cash container 10 into the receptacle 32. The guides 33 are also used to introduce the cash container 10 into the receptacle 32 in a defined manner such that the sliding means 34, constructed as a mandrel that protrudes from the back wall of the safe, can cooperate with the cover 12 of the cash container 10. For this purpose, when the cash container 10 is inserted, the sliding means 34 are guided through an opening (not shown) in the back wall 10*r* of the cash container 10 and pressed against the cover 12 constructed as a displaceable slide. Inserting the cash container 10 further leads to the cover 12 being moved into its position that uncovers the inlet opening 11. In the process the cover 12 is pushed through the gap between top wall 10*t* and stop element 21 until it meets the deflecting element 22 which is in turn released from the holding means 22 by the cover 12 that continues to move. The cash container 10 is accordingly back in the state shown in FIG. 2. The safe door 31 can be locked and cash received by the vending machine can pass through the chute opening 35 arranged in the safe and onwards through the inlet opening 11 located therebelow into the cash container 11.

Figure 7:
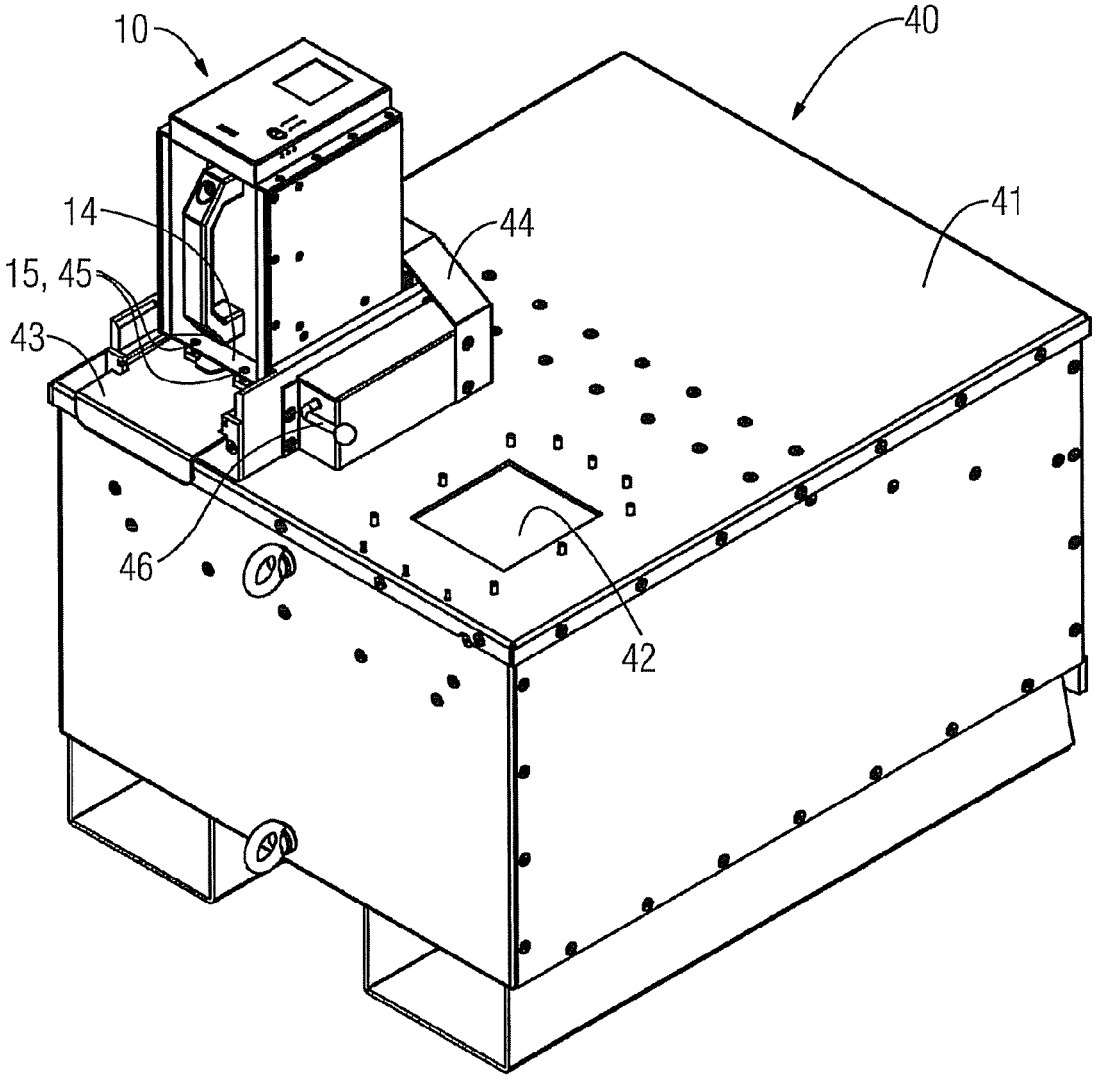
FIG. 7 shows a collecting box with connected cash container.

To empty the cash container 10 the safe door 31 is opened by a service person and the cash container 10 removed. As the cover 12 is coupled to a spring element the spring force, owing to the retreat of the sliding means 34, returns the cover 12 from its position uncovering the inlet opening 11 into a position that closes it. When the cash container 10 has been removed it is therefore not possible to access the cash stored therein. To empty the cash container 10 it is placed on a connecting mechanism of a collecting box 40. According to FIG. 7 the collecting box 40 has two filling openings 42 for cash which can be closed by a cover 43. FIG. 7 shows only the left-hand filling opening 42 with connecting mechanism and cash container 10, while the right-hand filling opening 42 is shown without. The connecting mechanisms are arranged on the top 41 and at the edge of the collecting box 40 to allow service personnel an optimally ergonomic posture when emptying a cash container 10. The connecting mechanism comprises a holder 44 which guides connection of a cash container 10 for emptying in such a way that pins 45 connected to the cover 43 engage in holes 15 in the door 14. This means that lifting of the cover 43 simultaneously opens the door 14. Joint opening of door 14 and cover 43 empties the cash contents of the container 10 into the collecting box 40 without direct access to the cash. A door lock for the door 14 and a cover key for the cover 43, each arranged on the back wall 10*r* of the cash container 10, and a cover lock for the cover 43 and a door key for the door 14 arranged on the holder 44 are not shown. When a cash container 10 is connected the keys are guided into the associated locks and can be actuated by a common lock element 46.

A collecting box 40 of this kind is arranged by way of example in a service vehicle (not shown) and owing to the weight of the container can only be removed from the cargo space thereof with a forklift truck. A series of vending machines or groups of vending machines for emptying can be reached using a service vehicle of this kind, it being possible to empty the cash contents of the collecting container 40 in a central office, for instance a bank, at the end of the service route.

The invention claimed is:

1. A cash container for receiving cash, comprising:

a top wall and a bottom wall, wherein the cash container is box-shaped;

an inlet opening closable by a cover, wherein the inlet opening is arranged on the top wall of the cash container;

an emptying opening for emptying the cash container, wherein the bottom wall comprises the emptying opening;

a sliding door for opening or closing the emptying opening;

a locking mechanism having a locked state in which the cover is locked in a position closing the inlet opening, and a release state in which the cover is unlocked in a position uncovering the inlet opening, a positioning element coupled to the sliding door, wherein the cover automatically closes the inlet opening when the cash container is removed from a vending machine, wherein the locking mechanism comprises the positioning element, and the positioning element comprises a lever mechanism, wherein by opening the sliding door, the lever mechanism forcibly transfers the locking mechanism from the locked state to the release state automatically and unlocks the cover to a position uncovering the inlet opening, wherein the sliding door only forcibly actuates the positioning element when the door has almost reached an open end position.

2. The cash container as claimed in claim 1, wherein the locking mechanism comprises a stop element movable between a locked position blocking the closed cover against opening, and a release position allowing the cover to open, and wherein the locking mechanism comprises a deflecting element coupled to the stop element, the stop element being movable against a restoring spring force from the blocked position into the release position by the deflecting element.

3. The cash container as claimed in claim 2, wherein the locking mechanism comprises a holding device fixing the deflecting element when the stop element reaches the release position.

4. The cash container as claimed in claim 3, wherein the lever mechanism is a double lever, a first lever being coupled to the door and a second lever arm being configured to position the deflecting element.

5. The cash container as claimed in claim 3, wherein the cover is displaceably arranged such that the deflecting element is released from the holding device when the cover is opened and the stop element is being prevented from springing back into the locked position until the cover is closed again.

6. The cash container as claimed in claim 5, wherein the displaceably arranged cover is coupled to a spring element having a spring force, the cover being movable from a position closing the inlet opening into a position uncovering the inlet opening against the spring force.

7. The cash container as claimed in claim 1, further comprising:

a front wall; and a C-shaped handle immovably fastened to the front wall.

8. The cash container as claimed in claim 7, wherein the handle is vertically oriented.

9. The cash container as claimed in claim 7, wherein the front wall comprises an indentation at least in the region of the handle.

10. The cash container as claimed in claim 7, wherein the handle is configured as a plastics material part with a rectangular cross-section at least in certain sections.

* * * * *